United States Patent [19]

Takegawa

[11] Patent Number: 4,756,344

[45] Date of Patent: Jul. 12, 1988

[54] PICK LENGTH SETTING METHOD AND DEVICE FOR USE WITH A PICKING APPARATUS

[75] Inventor: Yujiro Takegawa, Ishikawa, Japan

[73] Assignee: Tsudakoma Corp., Kanazawa, Japan

[21] Appl. No.: 72,449

[22] Filed: Jul. 13, 1987

[30] Foreign Application Priority Data

Jul. 14, 1986 [JP] Japan ..... 61-166071

[51] Int. Cl.[4] ..... D03D 47/36

[52] U.S. Cl. ..... 139/452; 242/47.01

[58] Field of Search ..... 139/435, 452; 242/47.01, 47.12, 47.13

[56] References Cited

U.S. PATENT DOCUMENTS 4,595,039 6/1986 Tholander .
4,627,474 12/1986 Tholander ..... 139/452
4,702,285 10/1987 Sugita ..... 139/452

FOREIGN PATENT DOCUMENTS 57-29640 2/1982 Japan .
60-28550 2/1985 Japan .
60-28552 2/1985 Japan .

*Primary Examiner*—Henry S. Jaudon

*Attorney, Agent, or Firm*—Wenderoth, Lind & Ponack

[57] ABSTRACT

In a picking apparatus comprising: a weft yarn measuring and storing device including pick length adjusting mechanism capable of varying pick length, for winding a weft yarn on a weft yarn measuring drum to measure and store the weft yarn on the weft measuring drum; a picking nozzle for inserting the weft yarn released from the weft yarn measuring drum into a shed of warp by means of a fluid jet; and a weft yarn detector disposed at a fixed position on the weft yarn arrival side, outside and near the warp; a pick length setting method comprising: a data input process in which data at least including a target adjustment length is given to calculating means; a calculating process in which data corresponding to the target adjustment, for adjusting the setting of the pick length adjusting mechanism is obtained through calculation; a pick length adjusting process in which an initial pick length is diminished or increased gradually during tentative picking operation to a pick length which causes the weft yarn detection signal of the weft yarn detector to change; and a target pick length setting process in which a final mode of operation of the pick length adjusting mechanism is decided on the basis of the calculated data corresponding to the target adjustment length.

5 Claims, 5 Drawing Sheets

PICK LENGTH SETTING METHOD AND DEVICE FOR USE WITH A PICKING APPARATUS

BACKGROUND OF THE INVENTION

1. Technical Field of the Invention

The present invention relates to a picking apparatus for a fluid jet loom and, more particularly, to a technique for automatically setting, in setting up a fluid jet loom for weaving a new fabric, a pick length accurately corresponding to a target pick length by increasing or decreasing a tentative pick length in a weft yarn measuring and storing device comprising a mechanism capable of changing set pick length, and capable of winding and storing a predetermined length of weft yarn on a measuring drum by means of a rotary yarn guide after the weft yarn has been checked.

2. Background Art

In a fluid jet loom, new weaving conditions weaving a new fabric is set before starting the loom for the normal weaving operation. A set pick length is one of those weaving conditions. The set pick length must be appropriate and accurate because an excessive set pick length increases waste yarn.

In such a drum type weft yarn measuring and storing device, a necessary pick length is set by changing the number (an integral number) of turns of a weft yarn on a measuring drum, by changing the diameter of the measuring drum or by changing a regular sequential selection of the releasing positions and the checking positions on the measuring drum. When a set pick length adjusting range is smaller than the length of one turn of the weft yarn on the measuring drum, a necessary pick length is set by changing the diameter of the measuring drum or by changing the regular sequential selection of the releasing positions and the checking positions. Such pick length setting methods are disclosed in U.S. Pat. No. 4,595,039 and Japanese Laid-Open Patent Publication Nos. 57-29640, 60-28550 and 60-28552. In either one of those pick length setting methods, setting an optimum pick length is impossible even if a target pick length is decided on the basis of the calculated circumference of the measuring drum or the regular sequential selection of the releasing positions and the checking positions is determined through calculation, because the tension of the weft yarn in measuring and winding the same on the measuring drum, the physical properties of the weft yarn, the type of the weft yarn and the process of manufacturing the weft yarn exert subtle influence on the actual pick length.

SUMMARY OF THE INVENTION

Accordingly, it is an object of the present invention to provide a pick length setting method and a pick length setting device capable of automatically setting an optimum pick length which will provide an actual pick length corresponding to a target pick length during tentative weft yarn measuring and storing operation in preparing a loom for a new weaving operation.

According to the present invention, a weft yarn of an excessive pick length, for instance, is inserted in a tentative weaving operation, then the excessive pick length is diminished sequentially during the tentative weaving operation until a weft yarn detector becomes unable to detect the free end of the inserted weft yarn, then the pick length is adjusted on the basis of the weft yarn detector, and then a final target pick length is determined.

The present invention employs a pick length adjusting mechanism for changing the pick length. A concrete pick length adjusting mechanism, for example, is a weft yarn checking mechanism for a weft yarn measuring and storing device, or a diameter changing mechanism for changing the outside diameter of the measuring drum, which changes the regular sequential selection of the releasing positions and the checking positions or changes the outside diameter of the measuring drum, respectively. These pick length adjusting mechanisms are described in the description of Embodiments 1 and 2 of the present invention.

According to the present invention, the free end of an actually insert weft yarn is detected, and then a pick length adjusting mechanism adjusts outside diameter of the measuring drum or decides a regular sequential selection of the releasing positions and the checking positions automatically so that the actual pick length coincides with a target pick length without requiring manual pick length setting operation, so that an accurate set pick length can be determined regardless of the physical properties of the weft yarn.

The above and other objects, features and advantages of the present invention will become apparent from the following description taken in conjunction with the accompanying drawings.

DESCRIPTION OF THE PREFERRED EMBODIMENTS

First Embodiment:

Prior to the description of the invention, a picking device for a fluid jet loom to which the present invention pertains will be described with reference to FIG. 1.

Figure 1:
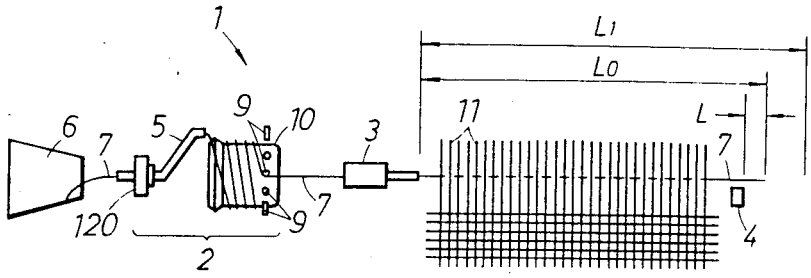
FIG. 1 is a general plan view of a picking device incorporating a pick length setting device, in a first embodiment, according to the present invention.

Referring to FIG. 1, a picking device 1 comprises a drum type weft yarn measuring and storing device 2, a picking nozzle 3 and a weft yarn detector 4.

Figure 2:
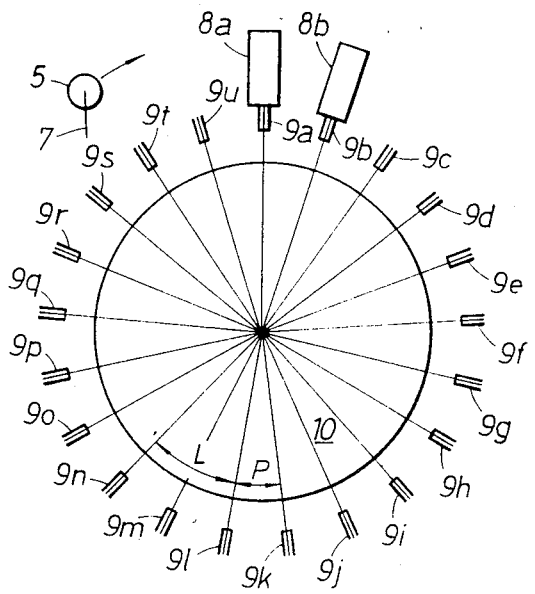
FIG. 2 is a front view of the measuring drum and weft yarn checking mechanism of the picking device of FIG. 1.

The weft yarn measuring and storing device 2 has a rotary yarn guide 5 which is driven by a driving motor 120 to pull out a weft yarn 7 from a yarn package 6 and winds the weft yarn 7 on a stationary weft yarn measuring drum 10. A weft yarn checking mechanism 9, i.e., an example of a pick length adjusting mechanism, has a plurality of checking pins *9a*, *9b*, . . . and *9u*, for example, twenty-one checking pins. The checking pins *9a* to *9u* are moved selectively toward and away from the weft yarn measuring drum 10 by pin operators *8a* to *8u*, respectively, so as to release the weft yarn 7 stored on the weft yarn measuring drum 10 in synchronism with a picking start timing and so as to check the weft yarn 7 in synchronism with a picking end timing. As best shown in FIG. 2, the checking pins 9*a* to 9*u* are arranged radially of the weft yarn measuring drum 10 at regular angular intervals.

When released, the weft yarn 7 is inserted together with a picking fluid jet into and across a shed of warp yarns 11 as far as the free end thereof reaches the so-called receiving side, namely a side opposite the picking side. The weft yarn detector 4 such as a photoelectric detector is disposed at an arrival position where the free end of the picked weft yarn 7 is to reach.

Figure 3:
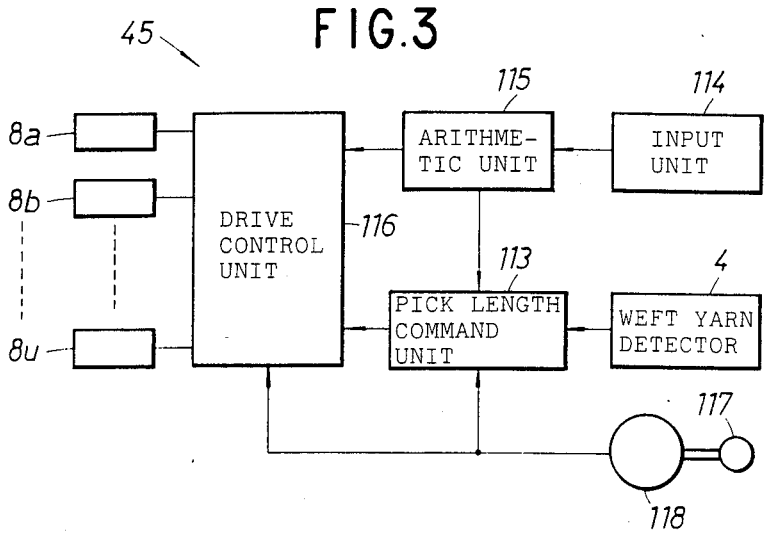
FIG. 3 is a block diagram showing the constitution of the pick length setting device of FIG. 1.

Referring to FIG. 3 showing the constitution of a pick length setting device 45, the weft yarn detector 4 is connected to an input terminal of a pick length command unit 113, while an input unit 114 is connected to an input terminal of an arithmetic unit 115, which in turn is connected to the pick length command unit 113. The pick length command unit 113 and the arithmetic unit 115 are connected to a drive control unit 116. The drive control unit 116 is connected to the pin operators 8*a* to 8*u* to drive the checking pins 9*a* to 9*u* selectively through the pin operators 8*a* to 8*u*, respectively. The phase angle of the main shaft 117 of the loom is detected by a phase angle detector 118. The phase angle detector 118 is connected to the pick length command unit 113 and the drive control unit 116. The pick length command unit 113 and the drive control unit 116 operate in synchronism with principal motions of the loom on the basis of signals given thereto from the phase angle detector 118.

In setting a new pick length, data of a target adjustment length L, a target pick length $O_0$ and a tentative pick length $L_1$, for example, a length greater than the target pick length $L_0$, (FIG. 1) based on weaving conditions are given to the arithmetic unit 115 by means of the input unit 114 (data input process). Then, the arithmetic unit 115 calculates the number of turns of the weft yarn 7 on the weft yarn measuring drum 10 corresponding to the tentative pick length $L_1$ with reference to the circumference of the weft yarn measuring drum 10 and the angular pitch P of the checking pins 9*a* to 9*u*, the operating sequence of the checking pins 9*a* to 9*u* to provide the tentative pick length $L_1$, and a correction for changing the checking position corresponding to the target adjustment length L (calculating process).

Suppose, for example, that the number of turns of the weft yarn 7 on the weft yarn measuring drum 10 corresponding to the tentative pick length $L_1$ is 3+5/21 turns. Then, the drive control unit 116 operates on the basis of the result of calculation to retract, for example, the checking pin 9*a* from a checking position of the circumference of the weft yarn measuring drum 10 in synchronism with the picking timing, and then advances the checking pin 9*f* to a checking position of the circumference of the weft yarn measuring drum 10 to check the weft yarn 7 after 2+5/21 turns of the weft yarn 7 has been unwound on the weft yarn measuring drum 10, so that the weft yarn is unwound from the weft yarn measuring drum by a length corresponding to two turns on the weft yarn measuring drum 10 and a length corresponding to a circumferential length between the checking pins 9*a* and 9*f*, namely, a length corresponding to 5/21 turns of the weft yarn 7 on the weft yarn measuring drum 10. The regular sequential selection of the releasing positions and the checking positions in this case is achieved by a sequence of advancement of the checking pin 9*a*, retraction of the checking pin 9*a*, advancement of the checking pin 9*f*, retraction of the checking pin 9*f*, advancement of the checking pin 9*k*, retraction of the checking pin 9*k*, advancement of the checking pin 9*p*, retraction of the checking pin 9*b* and the successive alternate advancement and retraction of every five checking pins after the checking pin 9*b*. Thus, the releasing and checking positions change sequentially from one to the other of the checking pins 9*a* to 9*u* in the direction of rotation of the rotary yarn guide 5.

Then, the loom is started for tentative weaving operation and the picking device repeats a picking motion to insert the weft yarn 7 of the tentative pick length $L_1$ into the shed of the warps 11 every picking cycle. When the target adjustment length L corresponds to twice the circumferential pitch P of the checking pins, a weft yarn checking position adjusting amount corresponds to two checking pins.

During the tentative picking operation, the pick length command unit 113 diminishes the tentative pick length $L_1$ stepwise, for example, by a length corresponding to the circumferential pitch P at a time. That is, the pick length command unit 113 gives commands to the drive control unit 116 to drive the check pins 9*a* to 9*u* selectively in an operating sequence to diminish the actual pick length by a decrement corresponding to the circumferential pitch P every picking cycle or every several picking cycles, so that the tentative pick length $L_1$ is diminished gradually (pick length adjusting process). During the pick length adjusting process, the driving motor 120 is controlled so that an appropriate length of the weft yarn 7 is stored on the measuring drum 10.

At the initial stage of the tentative weaving operation, the weft yarn detector 4 detects the free end of the picked weft yarn 7 because the tentative pick length $L_1$ is long enough for the free end of the picked weft yarn 7 to reach the detecting zone of the weft yarn detector 4. Upon the decrease of the tentative pick length $L_1$ to an extent where the free end of the picked weft yarn 7 is unable to reach the detecting zone of the weft yarn detector 4, the weft yarn detector 4 detects the absence of the free end of the weft yarn 7 in the detecting zone thereof and gives a weft yarn absence signal to the pick length command unit 113. Upon the reception of the weft yarn absence signal, the pick length command unit 113 interrupts diminishing the tentative pick length $L_1$. The final operating sequence of the checking pins 9*a* to 9*u* is decided on the basis of the operating arrangement of the weft yarn checking mechanism 9 at the moment of detection of absence of the free end of the picked weft yarn 7 by the weft yarn detector 4 and the calculated weft yarn checking position adjusting amount obtained through the calculating process, and the target pick length $L_0$ is decided (target pick length setting process). For example, suppose that the absence of the free end of the picked weft yarn 7 is detected by the weft yarn detector 4 when the checking pin 9*j* is retracted to release the weft yarn 7 and the same checking pin 9*j* is advanced to check the weft yarn 7 to unwind the weft yarn 7 for picking by a length corresponding to three turns. Then, the pick length control unit 113 selects the checking pin 9*l* located two pitches 2P after the checking pin 9*j* with respect to the direction of rotation of the rotary yarn guide 5 as a checking pin to be advanced to check the weft yarn 7 after the weft yarn 7 has been unwound by two turns, and then decides an operating sequence of the checking pins 9a to 9u on the basis of the positional relation between the checking pins 9j and 9l so that the weft yarn 7 of a length corresponding to 3+2/21 turns is unwound from the weft yarn measuring drum 10 for every picking cycle in the normal weaving operation. Accordingly, in this case, the checking pins 9a to 9u are actuated selectively in an operating sequence of the successive advancement and retraction of the checking pin 9l the checking pin 9n, the checking pin 9p, the checking pin 9r, the checking pin 9t, the checking pin 9a, the checking pin 9c and the successive advancement and retraction of every two successive checking pins.

EXAMPLE

Suppose that the number of the checking pins=21, the circumference of the weft yarn measuring drum 10=42 cm, weaving width=200 cm, horizontal distance between the weft yarn detector 4 and the adjacent selvage=5 cm, target adjustment length L=2 cm, and target pick length $L_0$=207 cm, and that a tentative pick length $L_1$=214 cm and the target adjustment length L=2 cm are given to the arithmetic unit 115 by means of the input unit 114. Then, the arithmetic unit 115 executes a numerical computation 214=42×5 (turns)+2×2 (pitches) to obtains five turns and two pitches. Then, the drive control unit 116 decides an operating sequence of the successive advancement and retraction of every two checking pins after the weft yarn has been unwound by four turns.

Although the first embodiment, similarly to the invention disclosed in Japanese Laid-Open Patent Publication No. 57-29640, has the weft yarn checking mechanism 9 provided with the plurality of checking pins 9a to 9u, the weft yarn checking mechanism 9 may be such as disclosed in Japanese Laid-Open Patent Publication No. 60-28552, comprising a single checking pin 9a and driving means for moving the checking pin 9a along the circumference of the weft yarn measuring drum 10. In such a known weft yarn checking mechanism 9, the checking pin 9a is operated at a releasing and checking position to supply the weft yarn for a picking cycle, and then the checking pin 9a is shifted to the next releasing and checking position, where the same is operated to supply the weft yarn for the next picking cycle. This driving means comprises, for example, a stepping motor. The weft yarn measuring and storing device 2 employed in the first embodiment of the present invention is capable of storing the weft yarn of a length corresponding to several pick lengths. However, the weft yarn measuring and storing device 2 may be substituted by a weft yarn measuring and storing device comprising a driving motor capable of driving the rotary yarn guide in synchronism with the weaving motion of the loom to store the weft yarn of a length corresponding to only a single pick length. In the latter weft yarn measuring and string device, the rotating speed of the output shaft of the driving motor and the weft yarn releasing and checking position are changed simultaneously. In the first embodiment, the tentative pick length $L_1$ is given by means of the input unit 14, and then initial setting data corresponding to the tentative pick length $L_1$ is calculated to set the weft yarn checking mechanism 9 for initial operating condition. However, the weft yarn checking mechanism 9 may be set initially so that, for example, the free end of the picked weft yarn 7 is able to reach a position at least beyond the weft yarn detector 4. Furthermore, such a weft yarn checking mechanism setting operation may be a manual setting operation.

Figure 4:
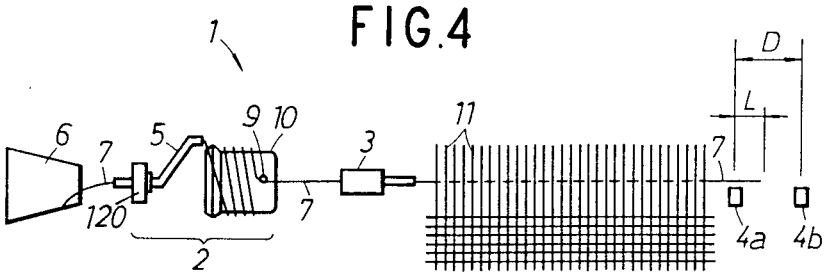
FIG. 4 is a general plan view of a picking device incorporating a pick length setting device, in a second embodiment, according to the present invention.

Second Embodiment:

Referring to FIG. 4 showing the general constitution of a picking device 1 for a fluid jet loom, incorporating a pick length setting device, in a second embodiment, according to the present invention, the picking device 1 comprises a drum type weft yarn measuring and storing device 2, a picking nozzle 3, a first weft yarn detector 4a and, if necessary, a second weft yarn detector 4b.

The weft yarn measuring and storing device 2 has a rotary yarn guide 5 which rotates to pull out a weft yarn 7 from a yarn package 6 and winds the same on a stationary weft yarn measuring drum 10. While the weft yarn 7 is being wound on the weft yarn measuring drum 10, a checking pin 9a is driven by a pin operator 8a for alternate repetition of advancement to and retraction from the circumference of the weft yarn measuring drum 10. The checking pin 9a is advanced to the circumference of the weft yarn measuring drum 10 to check the weft yarn 7 on the weft yarn measuring drum 10, while the same is retracted in synchronism with the picking motion of the picking device 1 to release the weft yarn 7 from the weft yarn measuring drum 10. When released, the weft yarn 7 is picked by the agency of a picking fluid jet into a shed of warp yarns 11 by the picking nozzle 3 so as to travel across the shed to the opposite selvage of the fabric being woven on the loom. Arrival of the free end of the picked weft yarn 7 at an arrival position is detected by the weft yarn detector 4a and, if necessary, the weft yarn detector 4b. The weft yarn detectors 4a and 4b are, for example, photoelectric detectors.

Figure 5:
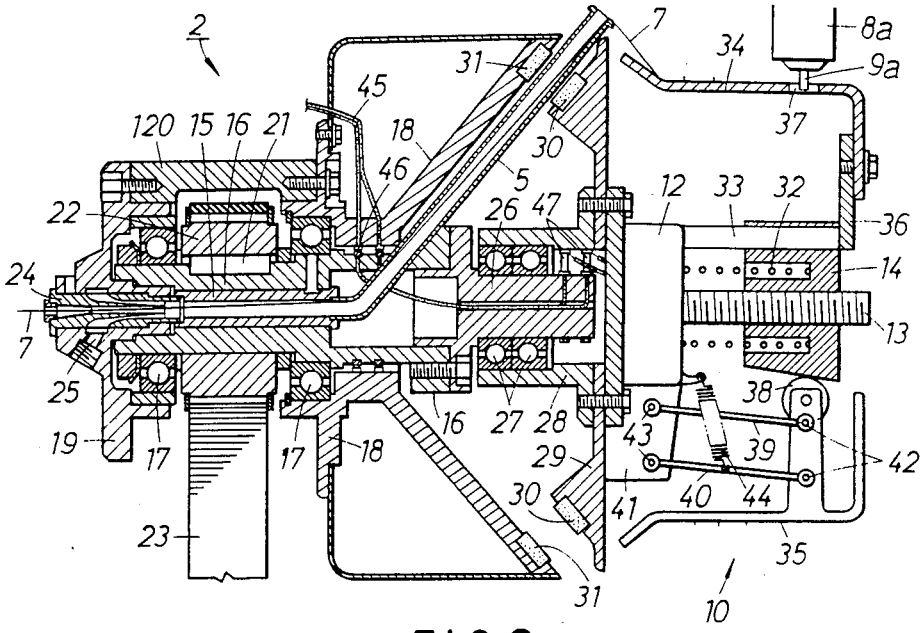
FIG. 5 is a longitudinal sectional view of the pick length setting device of FIG. 4.
Figure 6:
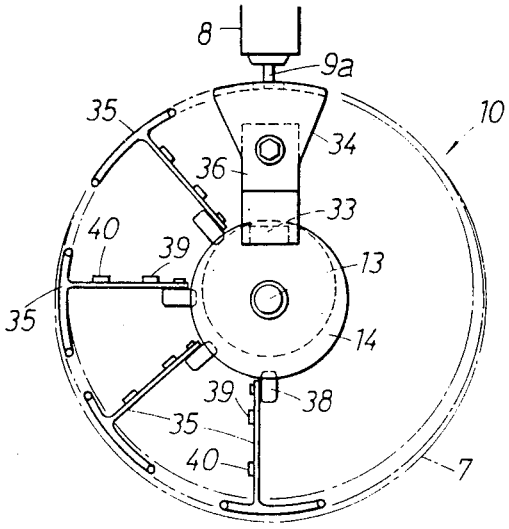
FIG. 6 is a front elevation of the measuring drum of the picking device of FIG. 4.

Referring now to FIGS. 5 and 6 showing the mechanical constitution of the weft yarn measuring and storing device 2, the weft yarn measuring and storing device 2 has a diameter changing mechanism for changing the outside diameter of the weft yarn measuring drum 10 in addition to the rotary yarn guide 5 and the weft yarn measuring drum 10. The diameter changing mechanism includes a motor 12 as driving means, a screw rod 13 which is driven by the motor 12, and a cam 14 having the shape of a frustum of an oblique circular cone and screwed on the screw rod 13 to form a screw pair. The rotary yarn guide 5 has one end fitted in the free end of a sleeve 15 disposed with the center axis thereof aligned with the axis of rotation of the rotary yarn guide 5. The sleeve 15 is fitted in a hollow rotary shaft 16 which in turn is supported in front and back bearings 17 on fixed housings 18 and 19. A timing pulley 22 is secured to the rotary shaft 16 with a key 21. Thus, the rotary shaft 16 is rotated through the timing pulley 22 and a timing belt 23 engaging the timing pulley 22 in synchronism with the main shaft of the loom, and thereby the rotary yarn guide 5 is rotated in synchronism with the main shaft of the loom within a cover 20. The weft yarn 7 introduced into a guide nozzle 24 fixed at the center of the housing 19 is urged by an air current introduced into the guide nozzle 24 through an air inlet 25 to advance through the rotary yarn guide 5.

An intermediate shaft 26 is fixed to the front end (right-hand end as viewed in FIG. 5) of the rotary shaft 16. A hollow shaft 28 is supported by bearings 27 on the intermediate shaft 26 for rotation relative to the intermediate shaft 26. A disk 29 and the motor 12 are secured coaxially to the intermediate shaft 26. Permanent magnets 30 are attached to the circumference of the disk 29, the permanent magnets 31 are attached to the housing 18 at positions opposite the permanent magnets 30, respectively. The disk 29 and parts mounted on the disk 29 are kept stationary by magnetic attraction between the corresponding permanent magnets 30 and 31 while the intermediate shaft 26 is rotated. The screw rod 13 is part of the output shaft of the motor 12. The motor 12, the screw rod 13 and the cam 14 are the principal components of the diameter changing mechanism. The cam 14 is in sliding engagement with a guide rod 33 extending in parallel to the screw rod 13, is urged always away from the motor 12 by a spring 32, and is restrained from rotation by the guide rod 33.

The weft yarn measuring drum 10 comprises a fixed frum segment 34 and a plurality of movable drum segments 35. The movable drum segments 35 are arranged on a circle having a center of the center axis of the screw rod 13, while the fixed drum segment 34 is fixed to a supporting plate 36 attached to the free end of the guide rod 33. A through hole 37 is formed in the fixed drum segment 34 at a position opposite the checking pin 9a. Each movable drum segment 35 has a substantially L-shaped form in side view and has a leg radially extending from the inner surface thereof. The leg of the movable drum segment 35, a pair of parallel links 39 and 40 of the same length and a bracket 41 attached to the disk 29 constitute a parallel linkage. The parallel links 39 and 40 are joined to the leg by pins 42 and to the bracket 41 by pins 43. An extension spring 44 having one end connected to the bracket 41 and the other end connected to the link 40 urges the movable drum segment 35 toward the center so that a roller 38 supported at the free end of the leg of the movable drum segment is kept in contact with the cam 14.

When the motor 12 is actuated, the cam 14 is moved by the screw rod 13 toward or away from the motor 12 depending on the direction of rotation of the screw rod 13. Since the cam 14 is always biased in one direction by the spring 32, the cam 14 is shifted without backlash in accurate proportion to the angle of rotation of the screw rod 13. When the cam 14 is moved axially by the screw-rod 13, the movable drum segments 35 are driven by the conical circumference of the cam 14 for radial translation to vary the effective outside diameter of the weft yarn measuring drum 10, while the fixed drum segment 34 remains unmoved. The cam profile of the cam 14 is so designed that the radial movement of the movable drum segments 35 near the fixed drum segment 34 is smaller than the radial movement of the movable drum segments far from the fixed drum segment 34, so that a substantially circular drum surface is formed by the fixed drum segment 34 and the movable drum segments 35 regardless of the radial position of the movable drum segments 35. Accordingly, the weft yarn 7 is unwound smoothly from the weft yarn measuring drum 10 along a spiral path around the weft yarn measuring drum 10 without entailing local variation of tension.

Figure 7:
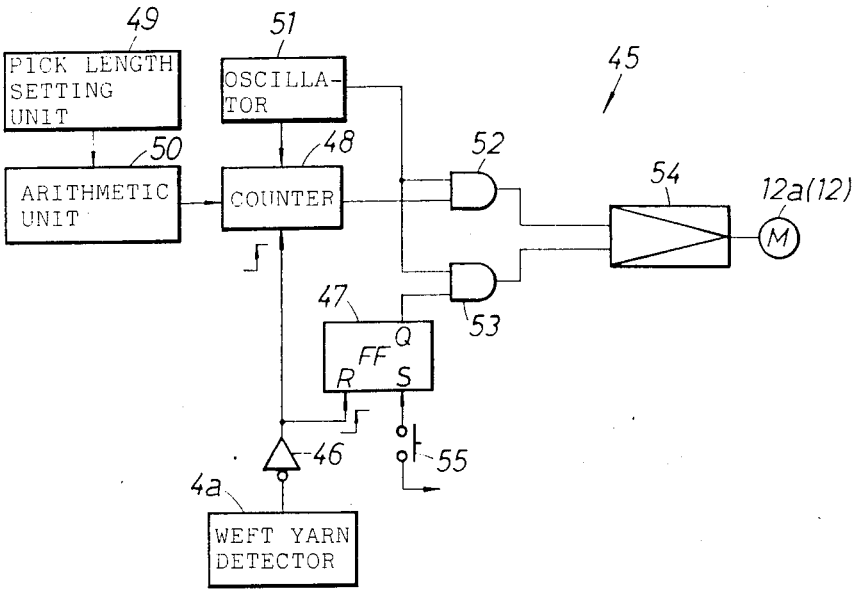
FIGS. 7 to 9 are block diagrams showing the constitution of the pick length setting device of FIG. 4.

Referring to FIG. 7 showing a pick length setting device 45, the weft yarn detector 4a is connected through a NOT circuit 46 to the reset terminal of a flip-flop 47 serving as control means and to the control input terminal of a counter 48. A pick length setting unit 49 is connected to an arithmetic unit 50 which in turn is connected to the preset input terminal of the counter 48. An oscillator 51 for driving the motor 12, in the second embodiment, a pulse motor 12, is connected to the input terminal of the counter 48 and to one of the input terminals of each of two AND gates 52 and 53. The respective output terminals of the flip-flop 47 and the counter 48 are connected to the respective other input terinals of the AND gates 52 and 53, respectively. The respective output terminals of the AND gates 52 and 53 are connected to the normal rotation signal input terminal and reverse rotation signal input terminal of a driving circuit 54, respectively. A setting switch 55 is connected to the set input terminal of the flip-flop 47.

In operation, first, a target adjustment length L determined with reference to the position of the weft yarn detector 4a is given from the pick length setting unit 49 to the arithmetic unit 50 (data input process). As shown in FIG. 4, the target adjustment length L corresponds, for convenience' sake, to a distance through which the free end of a picked weft yarn 7 travels beyond the weft yarn detector 4a. Then, the arithmetic unit 50 calculates the number of pulses corresponding to an angle of rotation of the output shaft of the pulse motor 12a necessary for increasing the effective outside diameter of the weft yarn measuring drum 10 by an increment corresponding to the target adjustment length L by using equations: $\Delta d = L/\pi N$ and $\alpha\theta = k \cdot \Delta d$, where $\Delta d$ is a necessary increment of the outside diameter of the weft yarn measuring drum 10, N is the number of turns, $\Delta\theta$ = a necessary angle of rotation of the output shaft of the stepping motor 12a, and k is a constant specific to the pitch of the thread of the screw rod 13 and the shape of the cam 14.

Thus, the weft yarn measuring drum 10 is set before hand in an outside diameter which provides a tentative pick length which allows the free end of a picked weft yarn 7 to reach a position beyond the weft yarn detector 4a with respect to the direction of travel of the picked weft yarn 7. Upon the start of the loom, the weft yarn measuring and storing device 2 starts the foregoing weft yarn measuring and storing operation, and the picking nozzle 3 is controlled according to the picking timing to pick the weft yarn 7 released from the weft yarn measuring drum 10 by retracting the checking pin 9a into the shed of the warp yarns 11.

During the weaving operation, a pick length setting switch 55 is closed to set the flip-flop 47, thereby an input of H-level is applied to one of the input terminal of the AND gate 53. Consequently, a pulse signal generated by the oscillator 51 passes the AND gate 53 and is applied to the reverse rotation singal input terminal of the driving circuit 54 to drive the pulse motor 12, namely, the pulse motor 12a, in the reverse direction and thereby the cam 14 is moved away from the motor 12, so that the outside diameter of the weft yarn measuring drum 10 diminishes in proportion to the angle of rotation of the output shaft, namely, the screw rod 13, and hence the pick length of the weft yarn 7 also diminishes in proportion to the angle of rotation of the output shaft of the motor 12. In a picking cycle during this tentative picking operation, upon the detection of the absence of the free end of the picked weft yarn 7 by the weft yarn detector 4a, the level of the output signal of the weft yarn detector 4a changes from H-level to L-level, and thereby the flip-flop 47 is reset to provide an output signal of L-level. Consequently, the AND gate 53 inhibits the passage of the pulse signal of the oscillator 51 to stop the motor 12 immediately (pick length adjusting process).

On the other hand, the output of L-level of the weft yarn detector 4a is inverted by the NOT circuit 46 into a signal of H-level, and then the signal of H-level is applied to the control input terminal of the counter 48. Then, the counter 48 subtracts the pulses given thereto from the oscillator 51 from a preset input value and applies an output signal of H-level to one of the input terminal of the AND gate 52 until the result of subtraction becomes zero. Accordingly, output pulse signals of the oscillator 51 is applied through the AND gate 52 to the normal rotation signal input terminal of the driving circuit 54 until the count registered on the counter 48 becomes zero to drive the motor 12 so that the output shaft thereof rotates in the normal direction. Consequently, the outside diameter of the weft yarn measuring drum 10 increases. Upon the arrival of the count registered on the counter 48 at zero, the level of the input signal applied to one of the input terminals of the AND gate 52 changes from H-level to L-level to inhibit the transmission of the output pulse signal of the oscillator 51 to the driving circuit 53, whereby the motor 12 is stopped immediately. Thus, the outside diameter of the weft yarn measuring drum 10 is adjusted automatically to a target outside diameter (target pick length setting process).

Figure 8:
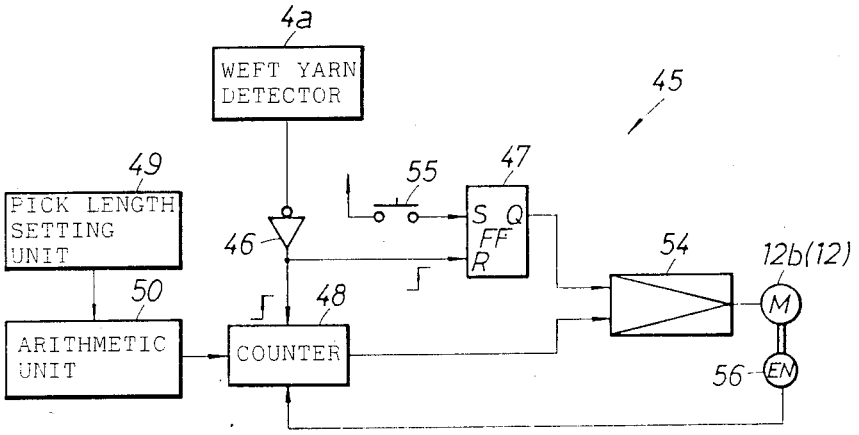

FIG. 8 shows a pick length setting device 45 in a modification of the second embodiment. This pick length setting device 45 employs a DC motor **12*a* as the motor 12. The angle of rotation of the output shaft of the DC motor 12*b* is detected by an encoder 56. The encoder 56 and a counter 48 are the components of a digital feedback path. The rest of the functions of the pick length setting device 45** is the same as those of the second embodiment.

Third Embodiment:

In the foregoing embodiments shown in FIGS. 7 and 8, the target adjustment length L is calculated on an assumption that the variation of the target adjustment length L is proportional to the variation of the circumference of the weft yarn measuring drum 10. A pick length setting device 45 in a third embodiment is contemplated for further accurate setting of a target adjustment length L.

Figure 9:
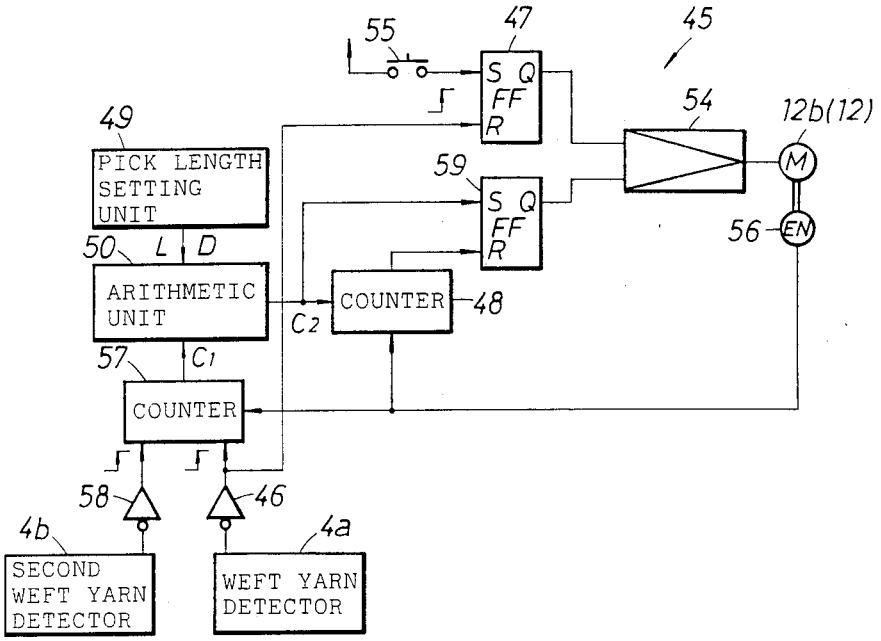

Referring to FIG. 9, the pick length setting device 45 includes two weft yarn detectors, namely, a first weft yarn detector **4*a* and a second weft yarn detector 4*b*, disposed at a predetermined distance D from each other. A necessary angle of rotation of the output shaft of a motor 12*b* for adjusting the outside diameter of a weft yarn measuring drum 10 for providing a target adjustment length L is calculated on the basis of the proportional relation between the angle of rotation of the output shaft of the motor 12*b* and the variation of pick length. The second weft yarn detector 4*b* is connected through a NOT circuit 58 to a counter 57, while the first weft yarn detector 4*a* is connected through a NOT circuit 46 to the counter 57 and to the reset input terminal of a flip-flop 47. The output terminal of an arithmetic unit 50 is connected to a counter 48 and to the set input terminal of a flip-flop 59. First, data representing the target adjustment length L and the distance D is given to the arithmetic unit 50 by means of a pick length setting unit 49 (data input process). Similarly to the initial setting operation in the second embodiment, the weft yarn measuring drum 10 is set beforehand for an outside diameter appropriate for providing a pick length which enables the free end of a picked weft yarn 7 reaches a position beyond the second weft yarn detector 4*b*. Upon the start of the loom, the weft yarn measuring and storing device 2 of the loom starts measuring and storing the weft yarn 7 and the picking nozzle 3 of the loom picks the weft yarn 7 released from the weft yarn measuring drum 10 into the shed of warp yarns 11 in synchronism with a picking timing. When a setting swtich 55 is closed during the operation of the loom, the output shaft of the motor 12*b* rotates in the reverse direction to diminish the outside diameter of the weft yarn measuring drum 10** continuously (pitch length adjusting process).

At the initial stage of the pitch length adjusting process, the second weft yarn detector **4*b* detects the free end of the picked weft yarn 7 and provides a detection signal of H-level. However, the second weft yarn detector 4*b* becomes unable to detect the free end of the picked weft yarn 7 in a short time because the pick length is diminished as the outside diameter of the weft yarn measuring drum 10 is diminished, and thereby the level of the output signal of the second weft yarn detector 4*b* changes from H-level to L-level. Consequently, the counter 57 is actuated to start counting the pulses of the output signal of the encoder 56. Upon the change of the level of the output signal of the first weft yarn detector 4*a* from H-level to L-level, the counting operation of the counter 57 is stopped and, at the same time, the arithmetic unit 50 gives a count value $C_1$ to the counter 57 and calculates a preset value $C_2$ by using an equation: $C_2=L/D$. Then, the counter 48 is set for the preset value $C_2$ (calculating process). On the other hand, the flip-flop 59 is set and thereby the output shaft of the motor 12*b* starts rotating in the normal direction, so that the pulses generated by the encoder 56 is subtracted from the count registered on the counter 48. Upon the reduction of the count registered on the counter 48 to zero, the flip-flop 59 is reset and thereby the motor 12*b* is stopped automatically (target pick length setting process). Thus, the outside diameter of the weft yarn measuring drum 10** is adjusted to an appropriate outside diameter.

To set a target pick length, the weft yarn detectors **4*a* and 4*b* can be substituted by a single length measuring means. The first weft yarn detector 4*a* can be used also as a weft feeler, while the second weft yarn detector 4*b* can be used also as a detector for detecting wrong picks and broken picks. Furthermore, the initial outside diameter of the weft yarn measuring drum 10 may be decided, similarly to the procedure in the first embodiment, by giving data representing a tentative pick length $L_1$ (FIG. 1) to the arithmetic unit 50 by means of the pick length setting unit 49** and calculating an outside diameter corresponding to the tentative pick length $L_1$.

Modifications:

In the foregoing embodiments, the completion of the adjustment of pick length to an appropriate pick length is detected by gradually diminishing a tentative pick length which is longer than the appropriate pick length and detecting the absence of the free end of the picked weft yarn 7 in the detecting zone of the weft yarn detector **4*a*. In a modification, the completion of the adjustment of pick length to an appropriate pick length may be detected by gradually increasing a tentative pick length which is shorter than the appropriate pick length and detecting the presence of the free end of the picked weft yarn 7 in the detecting zone of the weft yarn detector 4*a***. However, an excessively small tentative pick length will cause short pick, which is not desirable from the viewpoint of quality control of the fabric.

In the first embodiment, only a single weft yarn detector 4 is employed for deciding a final set pick length for the weft yarn checking device 2, however, the first embodiment may employ two weft yarn detectors **4*a* and 4*b*** as the third embodiment for the further accurate decision of a set pick length.

Furthermore, in the description of the foregoing embodiments, the pick length setting device 45 is shown by a functional block for convenience' sake, the functional elements of the pick length setting device 45 can be a programmable computer capable of the functions of memory, operation and control.

Although the invention has been described in its preferred forms with a certain degree of particularity, as many apparently widely different embodiments of this invention may be made without departing from the spirit and scope thereof, it is to be understood that the invention is not limited to the specific embodiments thereof except as defined in the appended claims.

What is claimed is:

1. In a picking apparatus comprising: a weft yarn measuring and storing device including pick length adjusting mechanism capable of varying pick length, for winding a weft yarn on a weft yarn measuring drum to measure and store the weft yarn on the weft yarn measuring drum; a picking nozzle for inserting the weft yarn released from the weft yarn measuring drum into a shed of warp by means of a fluid jet; and a weft yarn detector disposed at a fixed position on the weft yarn arrival side, outside and near the warp; a pick length setting method comprising:

a data input process in which data at least including a target adjustment length is given to calculating means;

a calculating process in which data corresponding to the target adjustment length, for adjusting the setting of the pick length adjusting mechanism is obtained through calculation;

a pick length adjusting process in which an initial pick length is diminished or increased gradually during tentative picking operation to a pick length which causes the weft yarn detection signal of the weft yarn detector to change; and a target pick length setting process in which a final mode of operation of the pick length adjusting mechanism is decided on the basis of the calculated data corresponding to the target adjustment length.

2. In a picking apparatus comprising: a weft yarn measuring and storing device including a pick length adjusting mechanism capable of varying pick length, for winding a weft yarn on a weft yarn measuring drum to measure and store the weft yarn on the weft yarn measuring drum; a picking nozzle for inserting the weft yarn released from the weft yarn measuring drum into a shed of warp by means of a fluid jet; and two weft yarn detectors disposed respectively at fixed positions at a predetermined distance from each other, on the weft yarn arrival side, outside and near the warp, for detecting the presence of the weft yarn in the respective detecting zones thereof; a pick length setting method comprising:

a data input process in which data at least including a target adjustment length and the distance between the weft yarn detectors is given to a calculating means;

a pick length adjusting process in which the mode of operation of the pick length adjusting mechanism is controlled to change an initial pick length to a pick length which causes the respective detection signals of the weft yarn detectors to change during tentative picking operation;

a calculating process in which the amount of adjustment carried out by the pick length adjusting mechanism from a moment when the detection signal of one of the weft yarn detectors changed to a moment when the detection signal of the other weft yarn detector changed during said pick length adjusting process is obtained, and an amount of adjustment to be executed by the pick length adjusting mechanism corresponding to the target adjustment length is calculated by using the former amount of adjustment on the basis of the proportional relation between the target adjustment length and the distance between the weft yarn detectors; and a target pick length setting process in which a final setting of the pick length adjusting mechanism is decided on the basis of the calculated amount of adjustment obtained in said calculating process.

3. In a picking apparatus comprising: a weft yarn measuring and storing device including a weft yarn checking mechanism capable of varying weft yarn releasing positions and weft yarn checking positions on the circumference of a weft yarn measuring drum, for winding a weft yarn on the weft yarn measuring drum for measurement and storage; a picking nozzle for inserting the weft yarn into a shed of warp by means of a fluid jet when the weft yarn is released from the weft yarn measuring drum; and a weft yarn detector disposed on the weft yarn arrival side, outside and near the warp, for detecting the presence of a weft yarn in the detecting zone thereof; a pick length setting method comprising:

a data input process in which data including at least a target adjustment length is given to calculating means;

a calculating process in which a weft yarn checking position adjusting amount for the weft yarn checking mechanism corresponding to the target adjustment length is calculated;

a pick length adjusting process in which a sequence of the weft yarn checking positions and the weft yarn releasing positions in the weft yarn checking mechanism is changed sequentially to diminish or increase an initial pick length gradually during tentative picking operation until the detection signal of the weft yarn detector changes; and a target pick length setting process in which an optimum sequence of the weft yarn checking positions and the weft yarn releasing positions is decided on the basis of the weft yarn checking position adjusting amount calculated in the calculating process after the detection signal of the weft yarn detector has changed.

4. A pick length setting device for a picking apparatus comprising: a weft yarn measuring and storing device including a plurality of weft yarn checking mechanisms capable of varying weft yarn releasing positions and weft yarn checking positions on the circumference of a weft yarn measuring drum, for winding a weft yarn on the weft yarn measuring drum to measure and store the weft yarn on the weft yarn measuring drum; a picking nozzle for inserting the weft yarn into a shed of warp by means of a fluid jet when the weft yarn is released from the weft yarn measuring drum; and a weft yarn detector disposed on the weft arrival side, outside and near the warp, for detecting the presence of the weft yarn in the detecting zone thereof; which comprises:

an input unit for giving data at least including target adjustment length;

an arithmetic unit which calculates a weft yarn checking position adjusting amount for the weft yarn checking mechanism corresponding to the target adjustment length;

a pick length command unit which changes an operating sequence of weft yarn releasing positions and weft yarn checking positions in the weft yarn checking mechanism in synchronism with the rotation of the main shaft of the loom during tentative picking operation to diminish or increase an initial pick length until the detection signal of the weft yarn detector changes, and decides an optimum operating sequence of weft yarn releasing positions and weft yarn checking positions on the basis of the weft yarn checking position adjusting amount for the weft yarn checking mechanism calculated by said arithmetic unit; and a drive control unit which drives a plurality of pin operators of said weft yarn checking mechanism selectively and sequentially in synchronism with the rotation of the main shaft of the loom on the basis of a command given thereto from said pick length command unit.

5. A pick length setting device for a picking device comprising a weft yarn measuring and storing device which changes the outside diameter of a weft yarn measuring drum on the basis of a control signal, a picking nozzle which inserts a weft yarn of a measured pick length released from the weft yarn measuring drum into a shed of warp by means of a fluid jet, and weft yarn detectors disposed at predetermined positions, respectively, on the weft yarn arrival side, outside and near the warp, for a fluid jet loom, which comprises:

a pick length setting unit for giving data including a target adjustment length;

an arithmetic unit which calculates, on the basis of the target adjustment length, a necessary amount of motion of driving means for driving means for varying the outside diameter of the weft yarn measuring drum;

control means which applies a signal provided by said driving circuit to said driving means in a directional amount of rotation corresponding to the respective modes of the detection signals provided by the weft yarn detectors; and a counter which subtracts a value representing the amount of rotation of said driving means from a value calculated by said arithmetic unit when the respective modes of the detection signals of the weft yarn detectors change.

* * * * *